United States Patent [19]

Lothmann et al.

[11] 4,168,790

[45] Sep. 25, 1979

[54] INTEGRATED SLIDE GATE VALVE

[75] Inventors: Josef Lothmann, Gruener; Ludwig Walther, Breitenbend, both of Fed. Rep. of Germany

[73] Assignee: USS Engineers and Consultants, Inc., Pittsburgh, Pa.

[21] Appl. No.: 847,197

[22] Filed: Oct. 31, 1977

[30] Foreign Application Priority Data

Nov. 19, 1976 [DE] Fed. Rep. of Germany ..... 2652593

[51] Int. Cl.[2] ..... B22D 41/08

[52] U.S. Cl. ..... 222/600; 222/504; 222/512; 251/193

[58] Field of Search ..... 222/504, 512, 561, 600; 251/144, 193

[56] References Cited

U.S. PATENT DOCUMENTS

| | | | |
|---|---|---|---|
| 4,063,668 | 12/1977 | Shapland et al. | 222/512 |
| 4,077,552 | 3/1978 | Lothmann | 222/600 |

FOREIGN PATENT DOCUMENTS

| | | | |
|---|---|---|---|
| 455803 | 2/1975 | U.S.S.R. | 222/600 |

*Primary Examiner*—David A. Scherbel

*Attorney, Agent, or Firm*—John F. Carney

[57] ABSTRACT

A sliding gate valve assembly for pouring liquid metal is described in which the frame that mounts the sliding plate is attached directly to oppositely spaced motor apparatus of particular design. Thus, in addition to imparting motion to the slide frame, the motor apparatus also serve to slidably mount the frame thereby eliminating the need for a housing enclosure about the slide frame. According to one aspect of the invention, the frame is movable longitudinally by motor apparatus on two opposed sides of the frame. According to another aspect of the invention, the frame is movable both longitudinally and transversely by pairs of motor apparatus rectangularly disposed about the four sides of the frame. Motor apparatus that is mechanically, electrically or fluid operated can be employed.

15 Claims, 13 Drawing Figures

INTEGRATED SLIDE GATE VALVE

BACKGROUND OF THE INVENTION

The present invention relates to a sliding gate valve for pouring molten metal, as for example, from the bottom of a receiving vessel such as a ladle or tundish. The valve of the invention includes a slide plate having at least one outlet port and being contained in a movable frame. The slide plate is spring-biased upwardly against a head plate located above the slide plate. The head plate contains an opening that communicates with the vessel interior and cooperates with that in the slide plate to pass molten metal from the receiving vessel when the openings are vertically aligned. The head plate is held by a mounting member connected to the bottom of the receiving vessel and the slide gate frame is held by a support device equipped with tensioning means for pressing the frame and its contained slide plate against the head plate.

In known sliding gate valves of the described type, the frame slides inside a housing forming part of the support device. Usually the housing is hinged to the mounting plate, and can be pressed against the mounting plate by means of suitable tensioning apparatus, including springs that are compressed between the frame and the slide plate, and thus force the slide plate up against the head plate. A pressure cylinder, operative to move the frame and slide plate relative to the head plate, laterally penetrates the housing to connect with the frame.

The use of an essentially closed housing as a support device has several disadvantages. A serious drawback is that even minor quantities of escaped liquid metal or other contaminants, for example, tar or sand, can obstruct the free motion of the relatively movable parts, so that the frame and the slide plate contained within it cannot be moved satisfactorily. The resultant operational disruptions can have far-reaching consequences. Furthermore, the fabrication and installation of the housing, the sliding members within it, and the pressure cylinder require considerable constructional effort and expense.

Therefore, it is the aim of the invention to further develop the above-described type of sliding gate valve in such a manner that the troublesome and structurally cumbersome housing is eliminated, and the drive for moving the frame is improved and simplified.

SUMMARY OF THE INVENTION

To achieve this aim the invention proposes to modify the above-described type of sliding gate valve so that the support for the slide plate is derived from the motor means that are also used for moving the slide plate relative to the head plate. Desirably, two motor units are located at opposite sides of the frame containing the slide plate and disposed parallel to its long dimension, with the components of these units, that are movable with respect to the vessel in the longitudinal direction of the frame, being connected with the frame.

In the sliding gate valve of this invention, the supporting housing and the glide arrangements contained within it are replaced by the motor units located on both sides of the frame, whereby these units also serve as supporting members as well as drives for imparting motion to the frame. The elimination of the housing results in a structure that is open on all sides so that it cannot be jammed by liquid metal or other contaminants and thereby operates trouble-free. Furthermore, the total construction effort and expense is obviously reduced by a considerable amount. The motor apparatus proposed by the invention assume the function of the housing and its sliding support for the frame, as well as the function of driving the frame.

An especially advantageous further development of the sliding gate valve according to the invention provides for the support device to have additional motor means for imparting transverse motion to the frame. These additional motors are desirably located on opposite sides of the frame parallel to its transverse dimension. The stationary components of the units are rigidly connected with respect to the vessel, and the components that are movable in the transverse direction of the frame support the stationary components of the motor means used for the longitudinal motion of the frame, thereby the frame can be moved selectively not only in its longitudinal direction, but also transversely to it. This arrangement is especially advantageous in that several pouring ports can be incorporated in the slide plate by arranging the ports, for example, in two rows staggered in the longitudinal direction.

The advantages arising from such an arrangement are obvious. The various ports may have different diameters, so that the metal pouring rate can be varied without changing the slide plates. Also, an increase in the number of ports increases correspondingly the expected service life of each slide plate. Moreover, the ability to move the frame sideways permits adjustment of the location of the ports in the pouring stream so that the very intensive wear at the edges can be distributed uniformly around the perimeter of each port. A transverse motion of the frame, while maintaining exact guides in the longitudinal as well as in the transverse direction, is not possible with the closed housing constructed in accordance with the known state of technology. Only the open construction using motor apparatus as supporting, guiding and motion imparting drive means proposed by the invention offers this opportunity.

To achieve favorable load relationships and a compact construction, it is further proposed that each motor unit utilized to impart longitudinal motion to the frame according to a preferred form of the invention, shall comprise a centrally located pressure-active cylinder and the connecting rods attached to a piston within the cylinder extending from both ends thereof, whereby the respective cylinders are connected with the frame and the free ends of the connecting rods are connected with the vessel mounting plate or with the components of the valve that are movable transversely of the frame, these components being part of the piston-cylinder units supported by the mounting plate and serving for transverse movement of the frame.

Similarly, each piston-cylinder unit for transverse motion of the frame may comprise a centrally located cylinder and connecting rods extending from both ends of the cylinder, whereby the cylinders are attached to the mounting plate and the free ends of the connecting rods are connected with the components that are movable in the longitudinal direction of the frame, these components being part of the piston-cylinder units for the longitudinal movement of the frame.

Various forms of tensioning apparatus can be employed in the operation of the gate valve of the present invention. In one form the tensioning apparatus can be located between the cylinder components for the longitudinal motion and the frame in a manner well known in the art. In this form the apparatus, on one side, includes a tensionable hinge joint and on the other side a tensionable releasable latch joint. Manually operated tensioning rods, such as those commonly used with gate valves having housings, may be employed in the present gate valve arrangement.

In another form, the tensioning device is located at the junctures between the motor units for the longitudinal motion of the frame and mounting plate, or between the motor units for the transverse motion of the frame. The tensioning device contains eccentric bushings that are rotated by an appropriate lever system to increase or decrease the tension. The lever system is moved in one or another direction by the longitudinal motion of the frame, as required.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
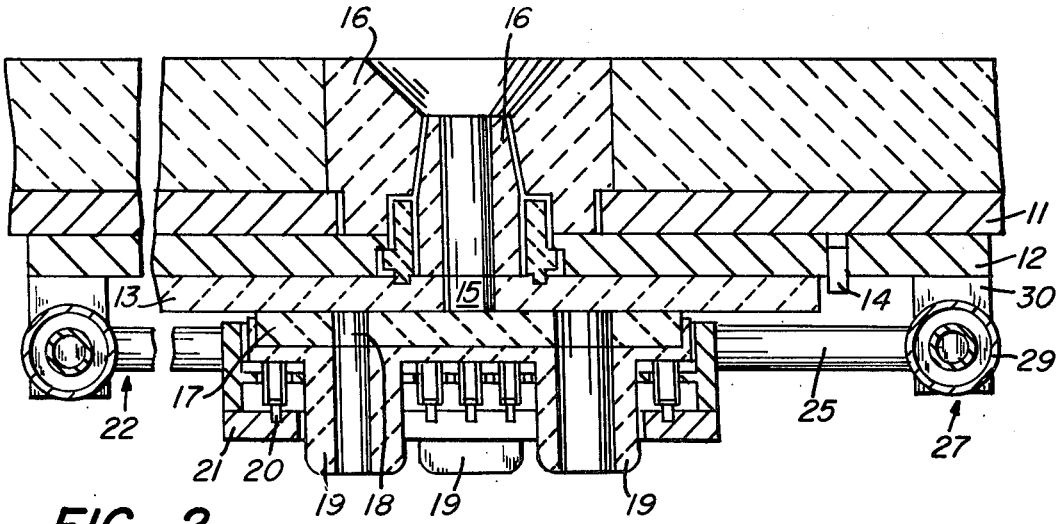
FIG. 1 is a vertical section taken along line 1—1 of FIG. 3 illustrating a first embodiment of the sliding gate valve of the present invention.
Figure 2:
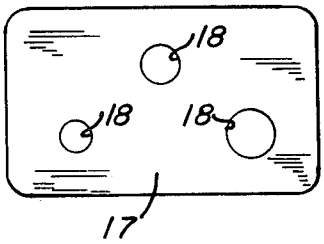
FIG. 2 is a schematic plan view of the slide plate used in the sliding gate valve shown in FIG. 1.

In FIG. 1, the bottom of a receiving vessel such as a ladle is indicated by the reference numeral 11. A mounting plate 12 is attached to the ladle bottom 11. Below the mounting plate lies a refractory head plate 13, secured by bolts 14 against horizontal motion. The ladle bottom 11, the mounting plate 12, and the head plate 13 are penetrated by a pouring port 15, which is lined inside with appropriate inserts 16. Adjacent to the lower surface of the head plate 13 is located a slide plate 17, which is also made of a refractory material.

The slide plate 17 contains several apertures 18, which are extended downward by tubes 19. The slide plate 17 is biased upwardly against the head plate 13 by means of springs 20. The springs 20 are supported by the frame 21, which is movable in the horizontal direction together with slide plate 17 contained within it.

Figure 3:
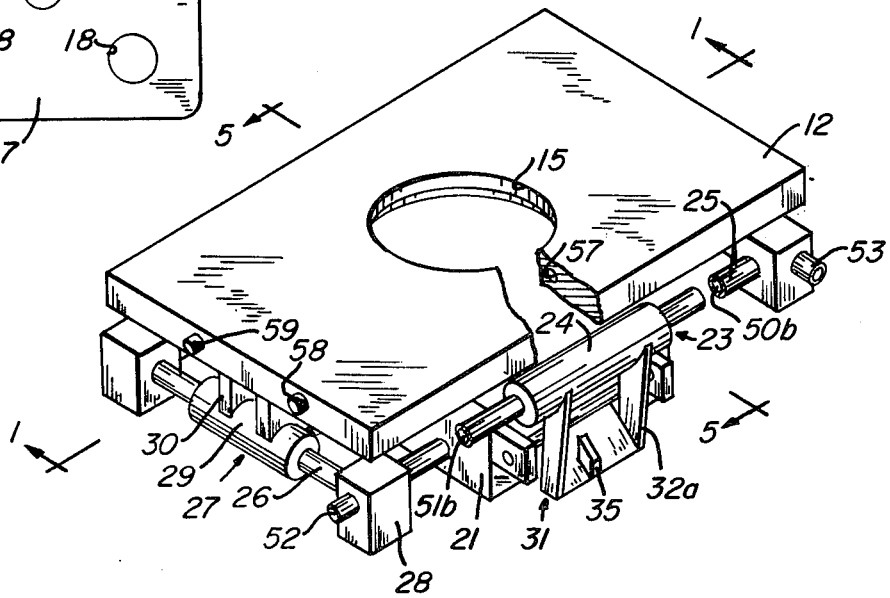
FIG. 3 is an isometric view of the sliding gate valve shown in FIG. 1.

The frame 21 is supported by a support device, which is indicated generally by the reference numeral 22. The support device also serves to move the frame 21 in the horizontal direction. FIG. 3 shows the construction and attachment of the support device 22 at the mounting plate 12, which, in FIG. 3, is shown detached from the ladle bottom 11.

The support device 22 contains two piston-cylinder units 23 located parallel to the long dimension of the frame 21 at opposite sides of it, only one unit being visible in FIG. 3. Each piston-cylinder unit 23, for the longitudinal motion of the frame 21 comprises a centrally located cylinder 24, which is connected with the frame 21 as shown in FIG. 5. Connecting rods 25 extend from opposite ends of a piston 25 (FIG. 4) enclosed within the cylinder and are operatively connected to the mounting plate 12. Toward this end, the free ends of connecting rods 25 are joined with the free ends of two further connecting rods 26 of the piston-cylinder units 27 located parallel to the lateral dimension of the frame 21 and operative to move the frame 21 in the transverse direction as hereinafter described by connector blocks 28 disposed at the four corners of the support device 22. The piston-cylinder unit 27 for the transverse motion of the frame 21 is constructed similarly to the piston-cylinder unit 23, for the longitudinal motion of the frame 21, but its cylinder 29 is rigidly connected with the mounting plate 12 by means of upright supports 30. Thus, the piston-cylinder units 23 and the piston-cylinder units 27, serve to jointly support the frame 21. The piston-cylinder units 23 and 27 can be supplied with a pressurizing agent in a known manner, and therefore can move the frame 21 in its longitudinal and/or transverse directions as described in more detail hereinafter.

Figure 6:
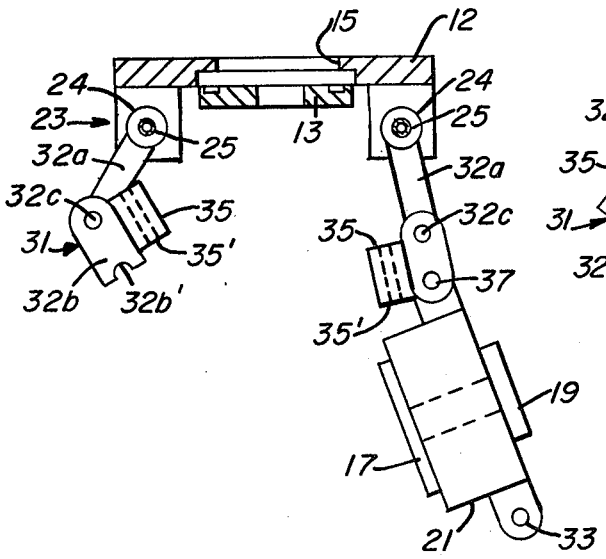
FIG. 6 is a sectional view illustrating the sliding gate valve in its unlatched position.

To move the frame 21 in the direction of the head plate 13 and to force the frame against the head plate, with consequent compression of the springs 20, the embodiment according to FIG. 3 provides for a tensioning device located between the cylinder 23 and the frame 21 and indicated in its entirety by the reference numeral 31. This tensioning device 31 is constructed as a known latch joint which is described in detail in U.S. Patent Application Ser. No. 609,344 filed Sept. 2, 1975 by E. P. and J. T. Shapland now U.S. Pat. No. 4,063,668. As shown in FIGS. 3, 5 and 6, it comprises an articulated lever 32, one member **32*a* of which is connected with the cylinder 24 and a notch 32*b*' in the other member 32*b* engages a horizontal bar 33, whereby the articulated joint 32*c* is movable beyond the dead-center as is indicated in FIG. 5 by the arrow 34. The articulated joint 32*c* is moved by a locking bar (not shown), which is inserted into a socket opening 35' in boss 35 on the lever 32*b*. In a similar manner, the hinge, located on the opposite side of the frame 21 between the frame and the cylinder 24, can be tensioned. This hinge connection, on the opposite side of the frame 21, is of identical construction except that the lever member 32*b* is permanently pivotably fixed by pins 32*d* to the frame. In principle, this mechanism is constructed similarly to the hinged joint used in conjunction with a slide gate housing. This construction permits the housing to swing away from the ladle bottom as shown in FIG. 6, after unlocking the latch, for example, to insert a new slide plate 17**.

Figure 4:
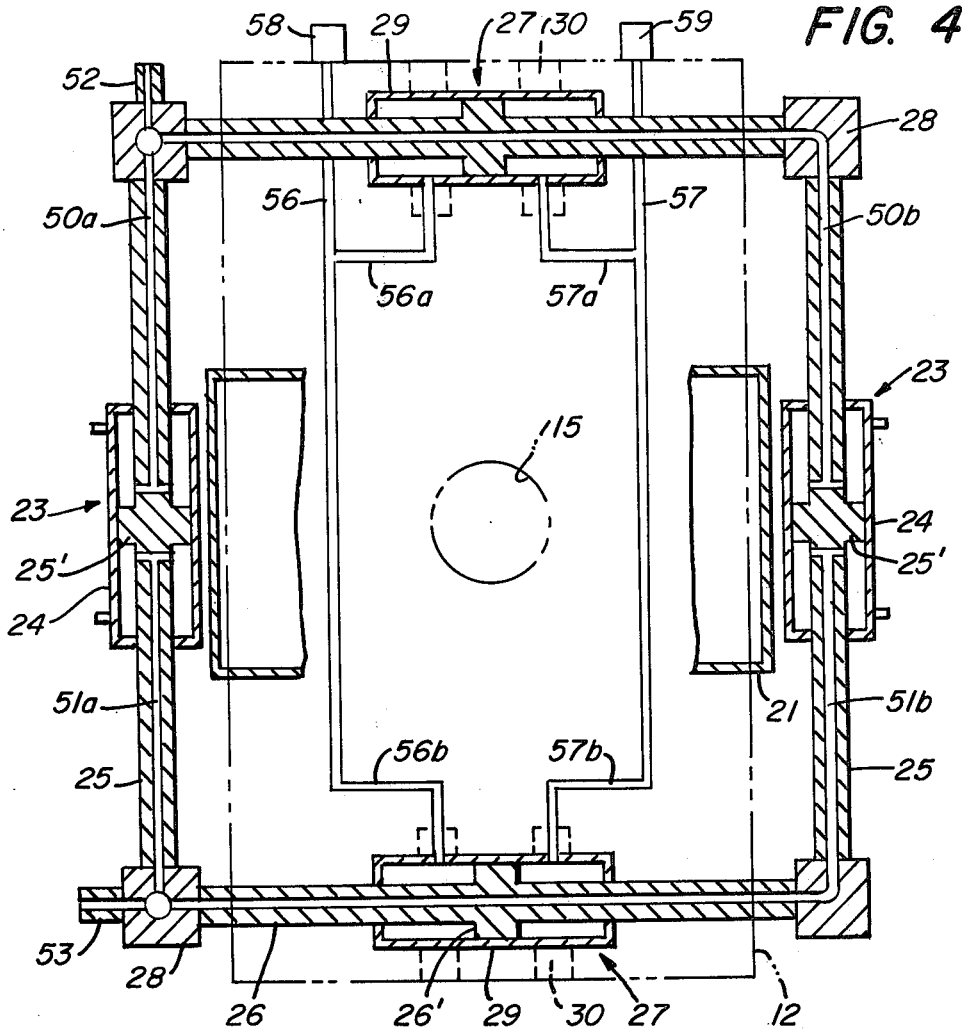
FIG. 4 is a schematic representation of the hydraulic system employed in the operation of the sliding gate valve of FIG. 3.
Figure 5:
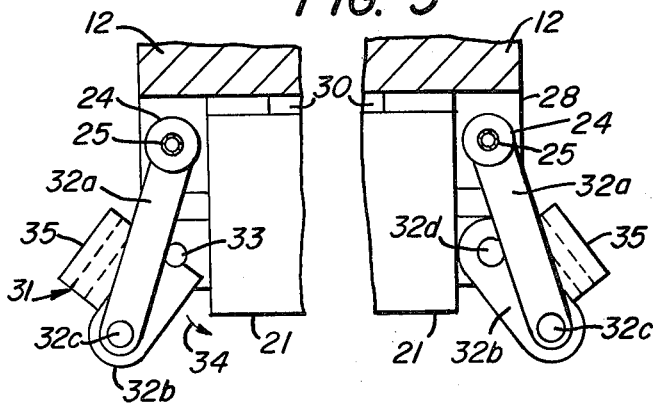
FIG. 5 is a vertical sectional representation taken along line 5—5 of FIG. 3.

The fluid system employed to effect movement of the frame 21 with respect to the mounting plate 12 is as shown in FIG. 4. That portion of the system which is operative in conjunction with the motor units 23 to move the frame 21 longitudinally of the mounting plate 12, shown in phantom in the drawing, comprises oppositely acting pairs of parallely-connected lines 50*a*, 50*b*, and 51*a*, 51*b* that connect between a fluid source (not shown) and the interior of the cylinders 24. As shown in the figure the lines are conveniently formed through the connecting rods 25 and 26 and connector blocks 28. Lines 50*a* and 50*b* are caused to communicate at one end with fluid port 52 and extend each to one of the respective cylinders 24, communicating therewith adjacent corresponding sides of the respective pistons 25'. Lines 51*a* and 51*b*, on the other hand, are similarly constructed and extend between port 53 and the cylinders 24, communicating therewith on the other corresponding sides of the pistons 25'. It will be appreciated that with the pistons 25', being effectively fixed with respect to the mounting plate 12, in order to move the frame 21 with respect thereto in the upward direction as it appears in the drawing figure, operating fluid is admitted by means of appropriate valving apparatus (not shown) through port 52 and lines 50*a* and 50*b* to the interior of the cylinders 24 on the upper sides of the respective pistons 25'. Simultaneously therewith, fluid from the lower sides of the pistons is released from the cylinders through lines 51*a* and 51*b* and port 53 to be returned to the source. The effect is to produce a resultant movement of the cylinders 24 and of the attached frame 21 longitudinally with respect to the mounting plate 12 in the upward direction as it is viewed in FIG. 4. When it is desired to move the frame 21 in the opposite direction, the described procedure is reversed.

That portion of the fluid system that is operative to move the frame laterally with respect to the mounting plate 12 comprises oppositely acting lines indicated as 56 and 57 formed interiorly of the thickness of the mounting plate 12. The lines 56 and 57 each connect at one end with the ports 58 and 59 respectively, that are attached to the mounting plate and which communicate with a source of operating fluid that is independent of the previously described source. The lines 56 and 57 have feeders offset therefrom, indicated by the subscripts a and b which communicate with oppositely spaced cylinders 29 of the motor units 27. In construction these offsets extend interiorly of the upright supports 30 which attach the cylinders 29 to the mounting plate 12. Feeders 56*a* and 56*b* communicate with the cylinders 29 on corresponding sides of the pistons 26', here shown as being the left side thereof, which feeders 57*a* and 57*b* communicate with the cylinders 29 on the opposite sides of the respective pistons. Thus, since the cylinders 29 are effectively fixed with respect to the mounting plate, to move the frame 21 from left to right as viewed in the drawing figure, operating fluid is admitted to line 56 through the port 58 from whence it flows through the line offsets 56*a* and 56*b* to the interior of the respective cylinders 29 on the left side of the pistons 26'. At the same time, fluid is released from the cylinders on the opposite sides of the respective pistons through offsets 57*a* and 57*b* and port 59 thereby producing a movement of the pistons 26' to the left. Since the entire support structure 22 and, thereby the frame 12, is operatively fixed to the pistons 26' movement of the pistons 26' to the left produces movement of the frame coincident therewith. When movement of the frame in the opposite lateral direction is desired, this procedure is reversed.

Figure 7:
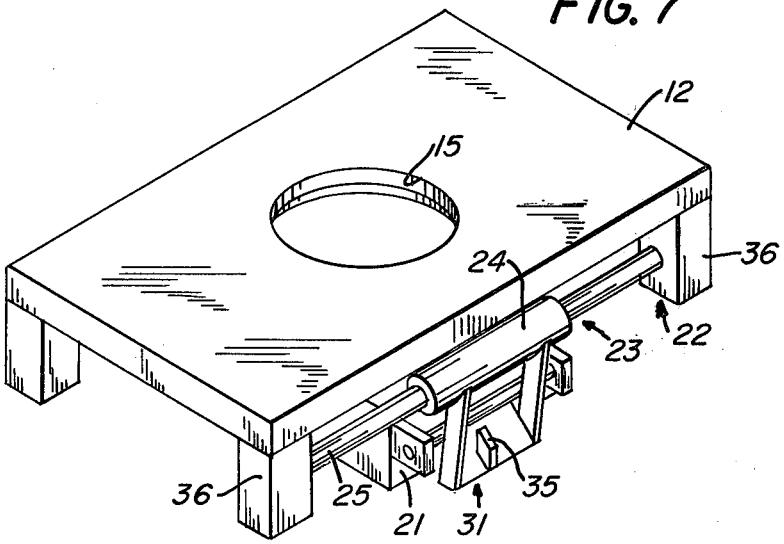
FIG. 7 is an isometric view illustrating a simplified embodiment of the sliding gate valve in which transverse mobility of the frame is omitted.

The embodiment of the support device 22' shown in FIG. 7 does not provide for transverse motion of the frame 21. In this embodiment of the invention the free ends of the connecting rods 25 of the piston-cylinder units 23 are rigidly connected with the head plate 12 at posts 36. Otherwise the construction shown in FIG. 7 corresponds with those shown in FIGS. 1 and 3, and the corresponding components are identified with the same reference numerals.

Figure 9:
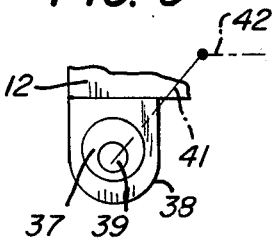
FIGS. 9 and 10 are illustrations of eccentric bushings utilized in the embodiment of FIG. 8.
Figure 10:
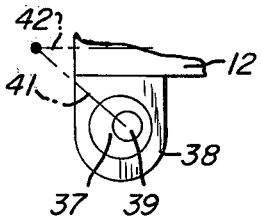
Figure 8:
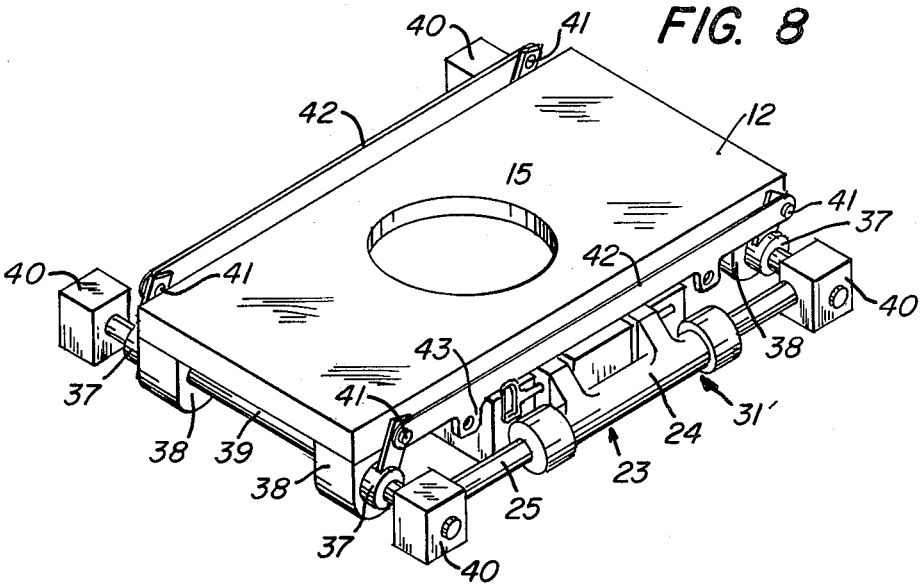
FIG. 8 is an isometric view, similar to FIG. 7, illustrating the sliding gate valve with an alternative form of tensioning means.
Figure 12:
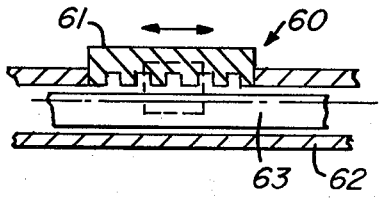
FIG. 12 is a partial sectional view of the motor means of FIG. 11.

The embodiment shown in FIG. 8 also does not provide for transverse movement of the frame 21, and to this extent it corresponds with that shown in FIG. 7. It differs from the embodiment shown in FIG. 7 by the construction of the tensioning device 31. The tensioning device 31' shown in FIG. 8 contains four eccentric bushings 37, which can be rotated in the bearings 38 located on the underside of the mounting plate 12. Support rods 39 extend through each pair of eccentric bushings 37, and the free ends of the support rods are connected through connectors 40 with the free ends of the connecting rods 25 of the piston-cylinder units 23, for the longitudinal movement of the frame 21. The cylinders 24 of the piston-cylinder units 23, are rigidly connected with the frame 21. By rotating the eccentric bushings 37 in the bearings 38 the support rods 39, the piston-cylinder units 23, and the frame 21 can be raised and tensioned (see FIGS. 9 and 10). The eccentric bushings are equipped with upward pointing levers 41. The upper ends of two levers 41 on the same side of the frame are joined by a connecting rod 42, which can be moved by the frame 21 in one or the other direction as desired. For this purpose, the connecting rod 42 contains on its underside projections 43, which can be connected with the frame 21 or can be disengaged from it. In this manner the frame 21 can move the connecting rod 42, the levers 41, and the eccentric bushings 37 in the direction of increasing or decreasing tension. The tensioning device of this embodiment of the invention is similar to that which is shown and described in greater detail in copending U.S. Patent Application Ser. No. 763,186 filed Jan. 27, 1977, by J. Lothmann, now U.S. Pat. No. 4,077,552.

Figure 11:
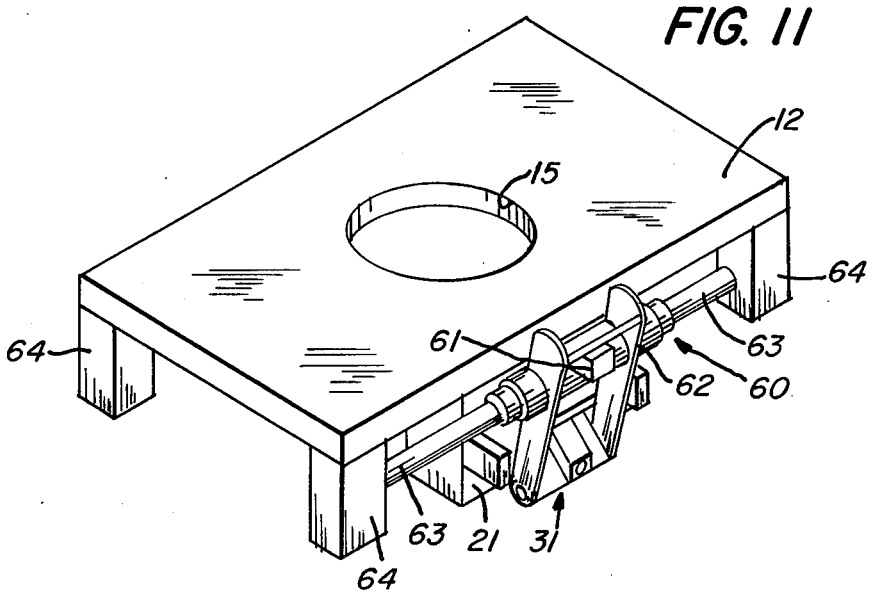
FIG. 11 is an isometric view, similar to FIG. 7 illustrating the sliding gate valve having an alternative form of motor means.
Figure 13:
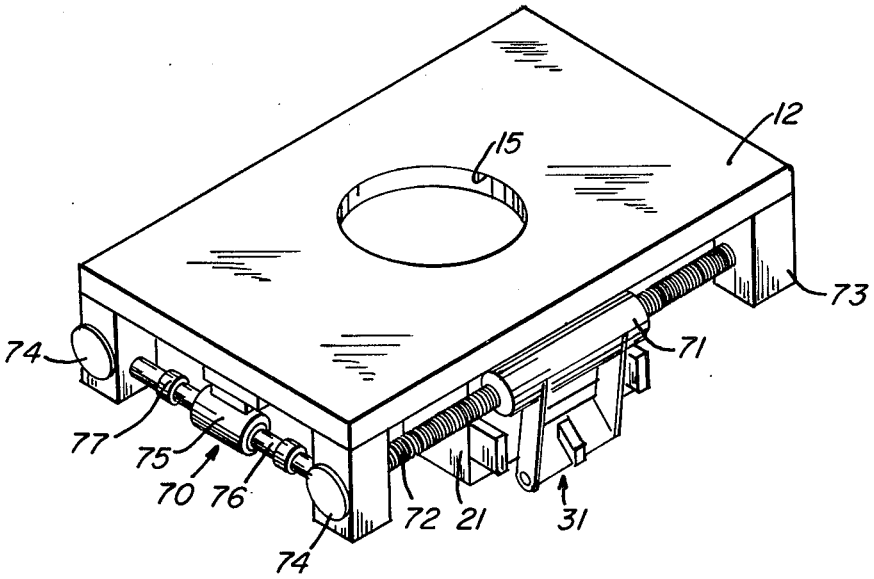
FIG. 13 is a plan view of the sliding gate valve equipped with yet another alternative form of motor means.

FIGS. 11 and 13 illustrate alternative forms of motor means for the gate valve herein. In the embodiment of FIG. 11 the sliding gate valve and support structure are in all substantial effects the same as those shown in FIG. 7 and as described in connection therewith. In this embodiment, however, the hydraulic motor units 23 of FIG. 7 are replaced by electrical linear induction motors indicated generally as 60. The linear induction motors 60 on the opposite sides of the frame 21 each comprise a moving inductor member 61 that is fixedly mounted on a sleeve 62 that attaches one end of the frame 21 and that surrounds an elongated rod 63 forming the secondary or reaction axis of the motor. As shown, the rods 63 are caused to extend between and are fixedly attached to oppositely spaced posts 64, the latter being disposed at the four corners of the mounting plate 12. In this embodiment of the invention, movement of the frame 12 is effected by imposing an electric current through the coils of the inductor members 61 to produce an axial movement thereof along the rods 63 thereby moving the frame 21 longitudinally of the mounting plate 12.

In the embodiment of FIG. 13, the frame 21 is driven by a reversible electric motor 70 through appropriate worm gearing and drive screws. As shown in the drawing figure the frame 21 is attached at its opposite ends to movable nut members 71. The nut members 71 are operated by drive screws 72 that extend along opposite sides of the mounting plate 12 between corner posts 73 and 74. Posts 73 contain appropriate bearings to permit rotation of the respective drive screws while posts 74 contain, in addition to the bearings, worm gear means to effect rotation of the drive screws, all as is well known in the art. The worm gears are in turn driven by a reversible electric motor 75 suspended from the mounting plate 12. The motor 75 connects with the respective worm gear apparatus through oppositely extending drive shafts 76 each of which contains clutch apparatus 77.

While the motor 75 has been described as being a reversible electric motor, this motor may, in some applications, preferably be a pressure-activated motor, such as, for example, a compressed air motor.

It will be understood that various changes in the details, materials and arrangements of parts which have been herein described and illustrated, in order to explain the nature of the invention, may be made by those skilled in the art within the principle and scope of the invention as expressed in the appended claims.

What is claimed is:

1. A sliding gate valve apparatus for a metal pouring vessel including a head plate having an aperture adapted to communicate with the vessel interior; a slide plate movable relative to said head plate and containing a pouring aperture cooperable with the aperture in said head plate to pass molten metal from said vessel interior when said apertures are in registry with one another; and means for moving said slide plate relative to said head plate; the improvement comprising said slide plate moving means being operable to support said slide plate relative to said head plate and including:

(a) at least one motor unit having a stationary member and a movable member;

(b) means for connecting said stationary member with respect to said head plate; and (c) means for connecting said slide plate to said movable member, whereby said slide plate is vertical supported by said movable member.

2. Apparatus as recited in claim 1 including a mounting plate attached to said vessel, support posts depending from opposite ends of said mounting plate, said motor unit including connecting rod means extending from opposite sides thereof and connecting at opposite ends with one of said posts whereby the movable member of said motor unit is movable along said connecting rod means and means for attaching said slide plate to said movable member.

3. Apparatus as recited in claim 2 in which said motor unit is electrically operated and said movable member includes linear inductor coil means operable with said connecting rod means for moving said slide plate with respect to said mounting plate.

4. Apparatus as recited in claim 2 in which said motor unit includes a reversible electric motor, said connecting rod means is externally threaded, means for operably connecting said motor to said connecting rod means for rotation thereof, and said movable member being nut means mounted on said connecting rod means.

5. Apparatus as recited in claim 1 in which said motor units each comprise a fluid pressure activated piston-cylinder unit.

6. Apparatus as recited in claim 5 in which each of said piston-cylinder units each includes a cylinder, a piston enclosed within said cylinder and a pair of connecting rods extending from opposite sides of said piston, and means for passing pressurizing fluid to said cylinder through passages provided in said connecting rods.

7. Apparatus as recited in claim 1 including an additional motor unit disposed transversely of said motor unit, said additional motor unit including a stationary member and a movable member, said stationary member being fixedly attached with respect to said vessel, and said movable member being attached to the stationary member of said motor unit whereby said slide plate is movable in both the longitudinal and transverse directions.

8. Apparatus as recited in claim 7 including motor units rectangularly disposed coincident with the sides of said slide plate, said motor units being arranged in pairs of simultaneously operated units, one of said pairs being disposed adjacent the longitudinal sides of said slide plate and operative to move said slide plate in the longitudinal direction and the other of said pairs being disposed adjacent the transverse sides of said slide plate and operative to move said slide plate in the transverse direction.

9. Apparatus as recited in claim 8 including a mounting plate attached to said vessel, said motor units each including a cylinder, a piston enclosed within said cylinder and a pair of connecting rods extending from opposite sides of said piston, means for attaching the cylinders of one of said pairs of units to said mounting plate, means for attaching the cylinders of the other of said pairs of units to said slide plate, and means for joining the free ends of adjacent connecting rods.

10. Apparatus as recited in claim 8 in which said slide plate is mounted in a frame, means for hingedly mounting said frame at one end to one of said motor units of the longitudinally disposed pair and means for releasably latching the other end of said frame to the other of the units of said pair.

11. Apparatus as recited in claim 7 including a slide plate having a plurality of pouring apertures disposed in staggered relation longitudinally of said plate.

12. Apparatus as recited in claim 1 in which said slide plate is mounted in a frame movable with said slide plate, said frame being attached to said movable member of said motor unit.

13. Apparatus as recited in claim 12 including spring means in said frame for biasing said slide plate against said head plate.

14. Apparatus as recited in claim 12 having oppositely spaced, parallelly extending motor units arranged for simultaneous activation attaching said frame at opposite ends thereof.

15. Apparatus as recited in claim 14 in which said frame is hingedly connected at one end to one of said motor units and the other end of said frame being releasably latched to the other of said motor units.

* * * * *